US006213319B1

(12) United States Patent
Khachaturian

(10) Patent No.: US 6,213,319 B1
(45) **Date of Patent: *Apr. 10, 2001**

(54) POWERED LIFTING APPARATUS USING MULTIPLE BOOMS

(76) Inventor: Jon E. Khachaturian, 5427 Sutton Pl., New Orleans, LA (US) 70131

( * ) Notice: Subject to any disclaimer, the term of this patent is extended or adjusted under 35 U.S.C. 154(b) by 0 days.

This patent is subject to a terminal disclaimer.

(21) Appl. No.: 09/460,479

(22) Filed: Dec. 14, 1999

Related U.S. Application Data

(63) Continuation of application No. 08/987,416, filed on Dec. 9, 1997, now Pat. No. 6,000,562, which is a continuation-in-part of application No. 08/780,846, filed on Dec. 9, 1996, now Pat. No. 5,836,463.

(51) Int. Cl.[7] ..... B66C 23/50
(52) U.S. Cl. ..... 212/270; 212/271; 254/124
(58) Field of Search ..... 212/294, 301, 212/199, 200, 201, 202, 203; 254/124

(56) References Cited

U.S. PATENT DOCUMENTS

| | | | |
|---|---|---|---|
| 2,572,336 | 10/1951 | Hall | 212/262 |
| 3,429,453 | 2/1969 | Kahle et al. | 212/257 |
| 4,041,875 | 8/1977 | Wallace | 212/324 |
| 4,535,900 | 8/1985 | Daniell | 212/262 |
| 4,538,849 | 9/1985 | Khachaturian | 294/81.5 |
| 6,000,562 | 12/1999 | Khachaturian | 212/270 |

FOREIGN PATENT DOCUMENTS

| | | | |
|---|---|---|---|
| 35848 | 8/1908 | (AT) | 212/262 |
| 914238 | 6/1954 | (DE) | 212/324 |
| 1280095 | 11/1961 | (FR) | 212/326 |
| 360313 * | 11/1972 | (SU) | 212/294 |
| 1337339 * | 9/1987 | (SU) | 212/301 |
| 1636325 * | 3/1991 | (SU) | 212/194 |

* cited by examiner

*Primary Examiner*—Thomas J. Brahan
(74) *Attorney, Agent, or Firm*—Garvey, Smith, Nehrbass & Doody, LLC

(57) ABSTRACT

A multiple boom lifting arrangement includes a plurality of preferably four carriages, each carriage having a boom with its lower end portion pinned to the carriage. Two of the carriages are placed on a common travel path with the upper end portion of their respective booms being pinned. This provides two spaced apart pairs of carriages and booms for lifting. A horizontal beam extends between the first pair of booms and the second pair of booms being attached to the pinned connection of each pair of booms with a sling. A powered motor-driven winch is used to power a cable that is wound between sheaves on the lower end portions of a pair of booms that are connected together. During use, the winches are simultaneously or nearly simultaneously operated to elevate the first pair of the booms and the second pair of booms at about the same time so that the horizontal beam that spans in between the pinned connections of-the first and second pairs of booms is elevated. Packages can be lifted with the horizontal beam by depending one or more slings from the horizontal beam to the package to be lifted. The apparatus can use carriages that are provided with wheels that travel on rails, rubber tires, or can be sled or skid-mounted without the use of wheels or tires.

41 Claims, 8 Drawing Sheets

10A
11
12
13
14
15
15A
15B
16
17
17A
17B
18
19
20
21
23
24
24A
25
30
31
45
46
48
53
147

POWERED LIFTING APPARATUS USING MULTIPLE BOOMS

CROSS-REFERENCE TO RELATED APPLICATIONS

This is a continuation of U.S. patent application Ser. No. 08/987,416, filed Dec. 9, 1997 (now U.S. Pat. No. 6,000,562), which is a continuation-in-part of co-pending U.S. patent application Ser. No. 08/780,846, filed Dec. 9, 1996, now U.S. Pat. No. 5,836,463, all of which are incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to heavy equipment, and more particularly to heavy lifting equipment that is used in commercial applications for lifting very heavy multi-ton objects that can weigh as much as several thousand tons. Even more particularly, the present invention relates to an improved heavy lifting apparatus that includes a pair of spaced apart trusses, each formed of a pair of booms, each pair being pinned at an upper boom end portion and load transfer carriages provided at the lower ends of the pair of booms, the carriages being connected with a tensile element (e.g., winch cable) that can be wound upon sheaves to increase the mechanical advantage. One of the carriages has a winch that pulls the cable and the two carriages together increasing the angle of inclination of each boom during a lift, a horizontal lifting beam being suspended below the booms for rigging the package to the horizontal beam.

2. General Background of the Invention

In the construction industry and at industrial plants, there is great expense associated with the lifting of very large objects such as chemical process vessels, large pieces of equipment, pre-fabricated buildings and the like. Such objects are typically lifted with one or more very large and expensive devices such as high capacity lifting booms or cranes.

These cranes must be brought into the facility and assembled on site before use when very large lifts are contemplated. This is a very time consuming and expensive operation costing millions of dollars, even for one lift in some cases where the load is very large (e.g., several thousand tons). Scheduling of large equipment can be critical, due to the limited number of very large capacity cranes world-wide and the time restraints and deadlines associated with plant expansions, turnarounds and renovations.

Some of the problems with the lifting of very large objects is the mobilization cost, the complex rigging that must be accomplished timely, and demobilization once the lift is completed.

Huge counterweights are required to equally distribute load, especially if soil conditions are less than perfect. With a crane, ground pressures can be 1000–5000 pounds per square foot. A foundation failure is one of the greatest concerns in any land heavy lift in the Gulf Coast area of the United States. With the present invention, soil bearing pressures are distributed to four carriages. Each carriage then further distributes the load in a balanced manner so that soil bearing pressure might be 100–500 pounds per square foot.

When moving the load (once lifted) over the ground, the present invention is far more stable than a crane that is walking a load. Another problem with crane lifts is that of a rotation or shifting of the object being lifted so that it hits the crane. During a lift, a crane boom is under such stress, that catastrophic failure can result when the object being lifted even lightly hits the crane.

The present invention can be positioned inside buildings without structural modifications that are required when an overhead crane is installed. The only constraint with the present invention is that the apparatus fit inside the building once assembled.

Cranes can also fail if the object being lifted moves (e.g., with wind load) out away from the center of the hook.

BRIEF SUMMARY OF THE INVENTION

The present invention provides an improved method and apparatus for lifting multi-ton packages such as chemical vessels, pre-fabricated structures, equipment packages and the like. This invention requires no counterweights, which can be costly to transport and assemble, because it operates using leverage against itself. Power requirements are reduced using this invention, as the power supply is the horizontal extendable member which carries only the horizontal component of boom load. Ground pressure, a significant problem associated with heavy loads, can be reduced by an order of magnitude by dividing the weight onto four evenly loaded carriages instead of eccentrically loading one crane matrix.

The method of the present invention first provides for the supporting of a first pair of booms from a first pair of carriages or vehicles, wherein the lower end portion of a first boom is pinned to a first carriage, and the lower end portion of the second boom is pinned to the second carriage. A second pair of booms is supported from a second pair of carriages, wherein the lower end portion of a third boom is pinned to a third carriage and the lower end portion of a fourth boom is pinned to a fourth carriage. Each pair of booms and its carriages defines a generally triangularly shaped variable dimension truss.

The method contemplates pinning the upper end portion of the first and second booms together. The method also contemplates pinning the upper end portion of the third and fourth boom together.

A lifting beam is generally horizontally positioned and suspended from the upper end portions of the respective pairs of booms, and preferably from the pinned connections of the two variable dimension trusses.

A package is lifted with rigging that depends from the lifting beam when a cable is tightened between the first and second carriages. Likewise, the lifting contemplates a tightening of a second cable that links the third and fourth carriages.

The apparatus of the present invention includes a plurality of carriages that define a structural base for supporting the load to be lifted.

Each truss supported by the plurality of carriages defines a load transfer between the carriages and the multi-ton packages to be lifted.

The trusses include the multiple booms extending respectively from the plurality of carriages and cables that extend in between the pairs of carriages during use.

A first pair of carriages supports a first pair of booms with upper end portions that are pinned together. A second pair of carriages supports the second pair of booms with upper end portions that are pinned together at pinned connections. A lifting beam is supported below the pinned connections.

A first extensible, powered lifting cable connects the first pair of carriages for pulling the carriages together so that the first pair of lifting booms increase in inclination during lifting, thus raising the apex of the first pair of booms and lifting the beam and the object to be lifted.

A second extensible, powered lifting cable connects the second pair of carriages for pulling the carriages together so that the second pair of lifting booms increase in inclination during lifting, thus raising the apex of the second pair of booms and lifting the beam and the object to be lifted.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 2A:
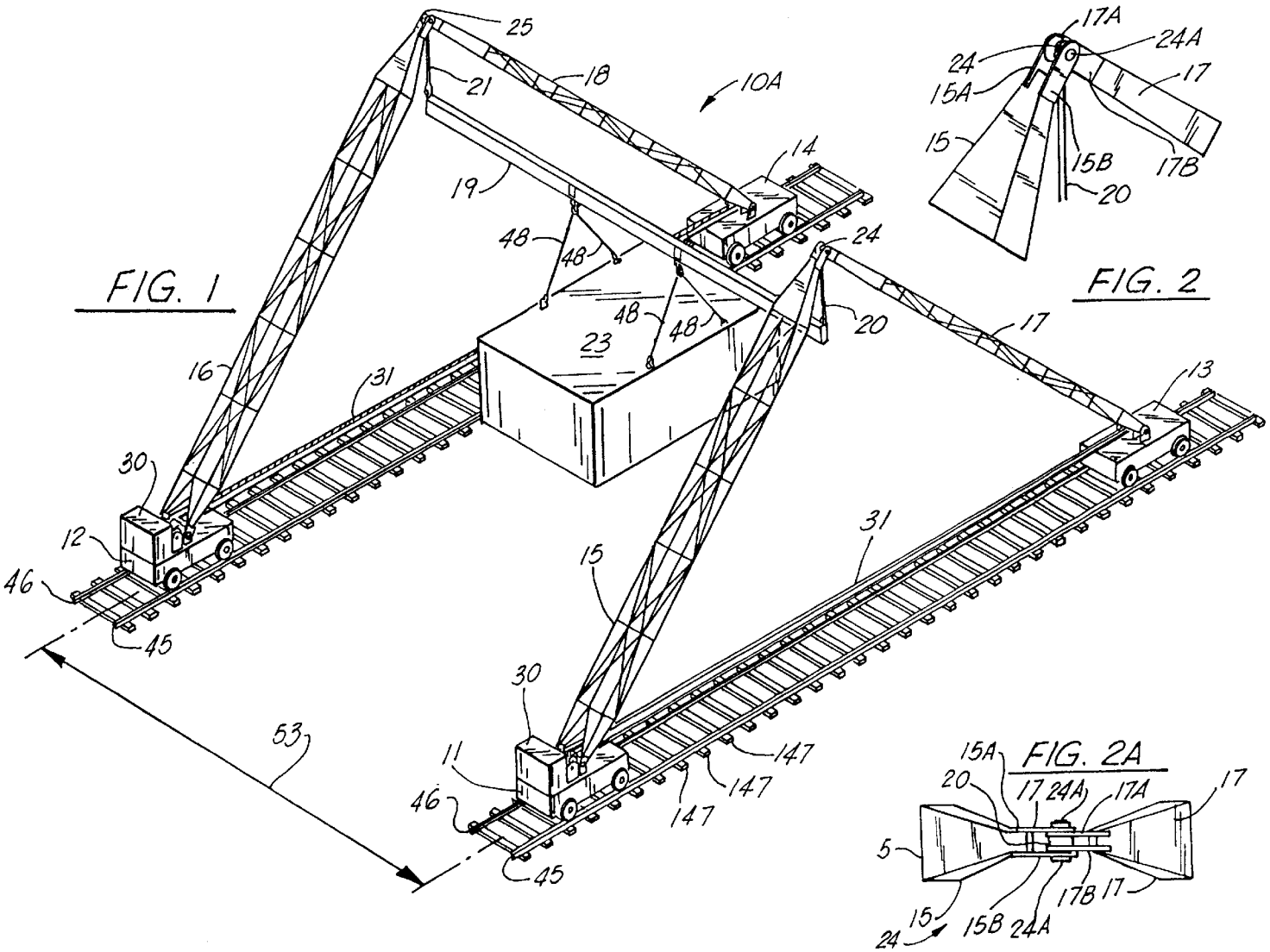
FIG. 1 is a perspective view of the preferred embodiment of the apparatus of the present invention.
FIG. 2 is a fragmentary view of the preferred embodiment of the apparatus of the present invention illustrating the pin connection at the top of a pair of booms.
FIG. 2A is a fragmentary view of the preferred embodiment of the apparatus of the present invention.
Figure 3:
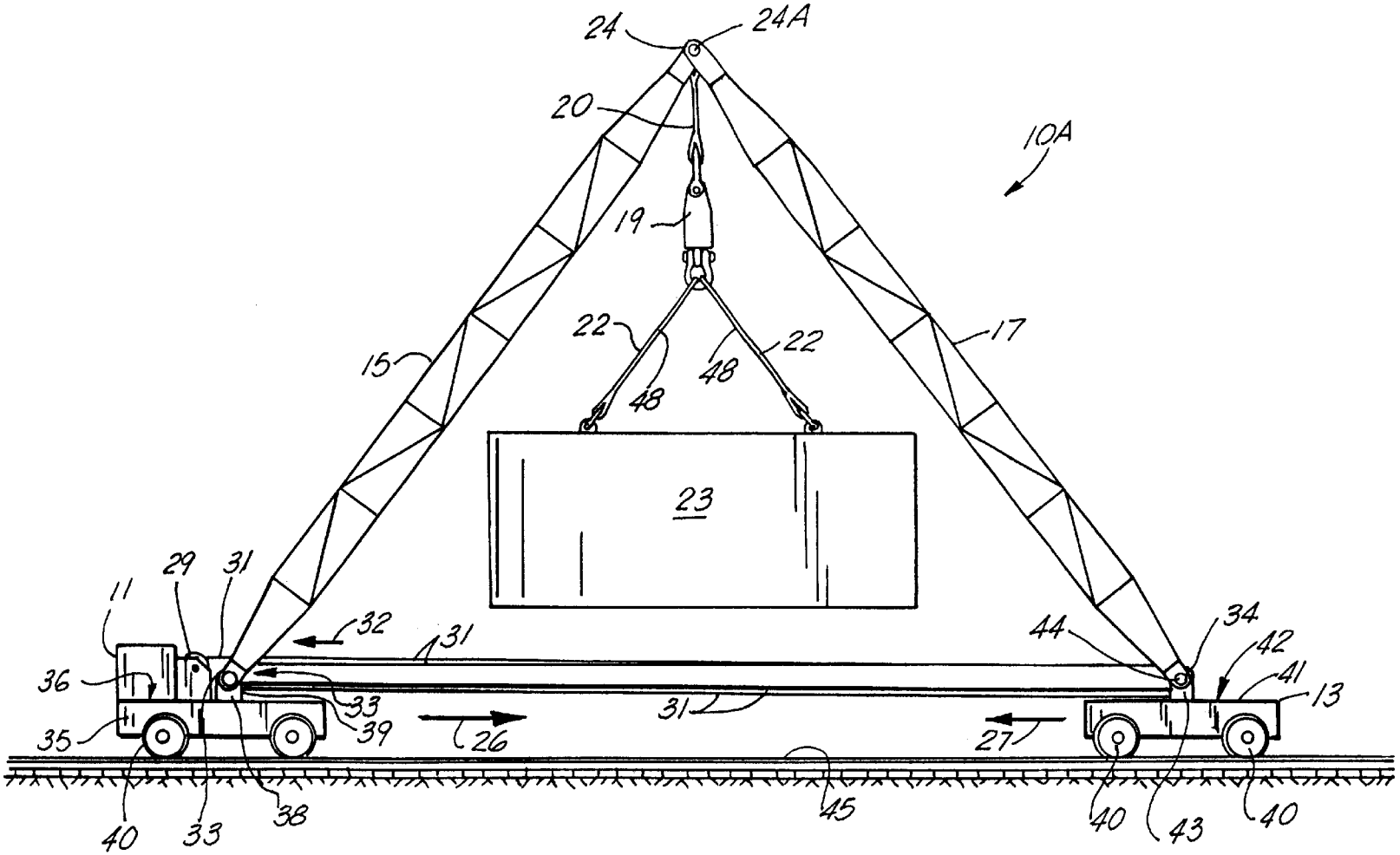
FIG. 3 is an elevational view of the preferred embodiment of the apparatus of the present invention.

FIGS. 1–3 show generally the preferred embodiment of the apparatus of the present invention designated by the numeral 10A in FIGS. 1 and 3.

Lifting apparatus 10 includes four carriages 11, 12, 13, 14. At least two of the carriages 11 are powered, having winches 29 thereon for pulling a cable 31 that is wound upon sheaves 33, 34. The carriages 11, 12 are powered carriages that have winches 29 thereon, each of the winches 29 being powered with a motor drive.

The carriages, 13, 14 are not powered but each has a sheave 34 thereon. Each sheave is wound with the cable 31 as shown in FIGS. 1 and 2. During use, the winch 29 and sheaves 34 are wound so that the two carriages 11, 13 move together when the winch 29 takes up cable. Similarly, the two carriages 12, 11 move together when cable 31 is wound upon winch 29 of carriage 12.

Four booms 15, 16, 17, 18 are provided with the apparatus 10 of the present invention. The booms are arranged in pairs as shown in FIG. 1. Booms 15 and 17 are attached at their upper end portions together at pinned connection 24. The booms 16, 18 are pinned together at pinned connection 25.

A detail of pinned connections 24 or 25 can be seen in FIGS. 2 and 2A wherein pinned connection 24 is shown. The connection 25 is the same as that shown in FIG. 2 for connection 24. The boom 15 has end portions 15A, 15B that attach to transverse load pin 24A. The boom 17 has end portions 17A, 17B that attach to the pin 24A. Link or sling 20 extends downwardly from pin 24A as shown in FIG. 2. Sling 20 can be a wire rope sling (or slings) with a loop or eyelet end portion that fits pin 24A.

A horizontally extended beam 19 is supported by the spaced apart sling members 20, 21. Each sling 20, 21 is pinned to a transverse pin 24A or 25A of the pinned connections 24, 25 as shown in FIGS. 1–3. Sling 20 hangs from pin 24A of pinned connection 24. Sling 21 hangs from pin 25A of pinned connection 25. Each sling 20, 21 attaches at its lower end to beam 19 using shackles for example. Slings 20,21 could be rigid links.

The transverse beam 19 is preferably of a length equal to the spacing in between the first pair of booms 15, 17 and the second pair of booms 16, 18. The length of beam 19 is also equal to the spacing between the pairs of tracks 46, 47 shown in FIG. 1, that spacing being designated by the numeral 53 in FIG. 1. A package 23 is shown being supported below beam 19 with sling 22 and rigging 48. Additional spreader bars or beams could be used to lift vessels, coal boxes, generators, or any other object that could be lifted with a crane or jacking system.

During use, the winch 29 of carriages 11 and 12 is powered with a motor (e.g., hydraulic) drive 30 so that the winch 29 can be wound to pull cable 31 in the direction of arrow 32. This causes the carriages 11 and 13 to move together in the direction of arrows 26 and 27 and upon rails 45, 46. As the carriages 11, 13 move closer together, the inclination of booms 15, 17 increases thus elevating the apex 24, 25 of the pair of booms 15, 17 and 16, 18 and package 23 in the direction of arrows 28.

Sheaves 33 and 34 can be used to increase the mechanical advantage afforded during lifting by multiplying the number of windings that cable 31 makes in between the sheaves 33, 34. Cable 31 is wound upon winch 29, then wound a desired multiple times upon sheaves 33 and 34, then anchored at 39 to carriage 11. Because the beam 19 is horizontally extending, a plurality of slings such as 22 can be depended from the beam 19 and at spaced apart locations along the beam 19. This helps in the lifting of horizontally extending objects such as horizontal chemical process vessels and the like. This also enables relatively low power winches to be used when lifting very heavy objects. For example, if a 1000 ton object is to be lifted, a crane would require a 1000 ton vertical hoist capacity. Such a crane would require expensive rigging such as a 1000 ton block. A crane of this capacity costs in the range of several million dollars, a $10,000,000 price being an example.

With the present invention, the booms 15, 17 and 16, 18 could be for example, 50 feet long. For a 1000 ton object and a 60 degree boom angle for each boom, boom load would be about 288 tons. This only requires a 30,000 line load for the cable 31 if, for example, about 12 parts of line are wound upon the sheaves 33, 34.

Each carriage 11, 13 has a chassis 35, 41 respectively. The carriage 11 is shown more particularly in FIG. 2 as including a chassis 35 having an upper surface 36. The upper surface 36 carries motor drive 30 for powering the winch 29. The upper surface 36 also has a plurality of padeyes 38 for supporting the lower end portion of a boom 15, forming a pinned connection 37 in between the boom 15 or 16 and its padeyes 38. Carriage 12 and its boom 16 are of the same general construction as carriage 11 and its boom 15. Carriage 14 and its boom 18 are of the same general construction as carriage 13 and its boom 17.

A cable anchor 39 in the form of a reinforced padeye, for example, can be used to anchor the free end of cable 31 after it is wound the desired number of times about sheaves 33 and 34. In the embodiment of FIGS. 1–3, a plurality of rail engaging type wheels 40 is provided for each carriage 11, 12, 13, 14, each wheel 40 being designed to travel on the pairs of spaced apart rails 46, 47 shown in FIG. 1.

The carriages 13 and 14 each provide a chassis 41 having an upper surface 42 that carries one or more padeyes 43. The padeyes 43 enable a pinned connection 44 to be formed between the lower end portion of the booms 17 and 18 respectively with the carriages 13 and 14, as shown in FIGS. 1 and 3.

The rails 45 and 46 can be supported by a plurality of crossties 47, for example. Rigging 48 can be used to rig a particular package 23 to one or more slings 22 and shackles that depend from horizontal beam 19.

Figure 4:
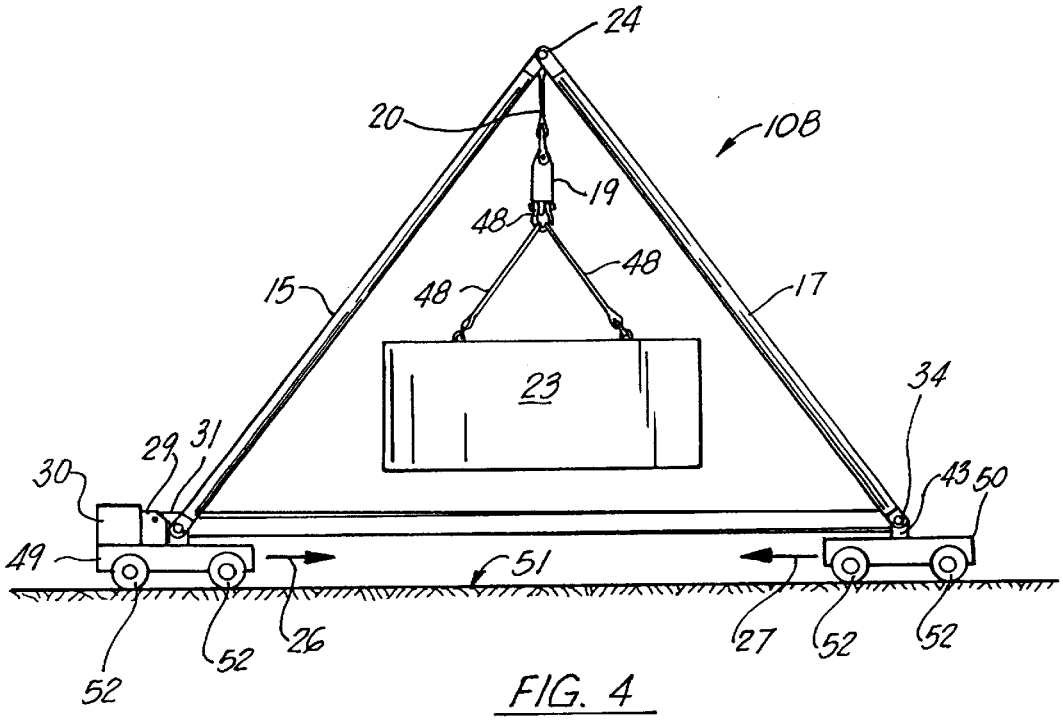
FIG. 4 is an elevational view of a second embodiment of the apparatus of the present invention.
Figure 5:
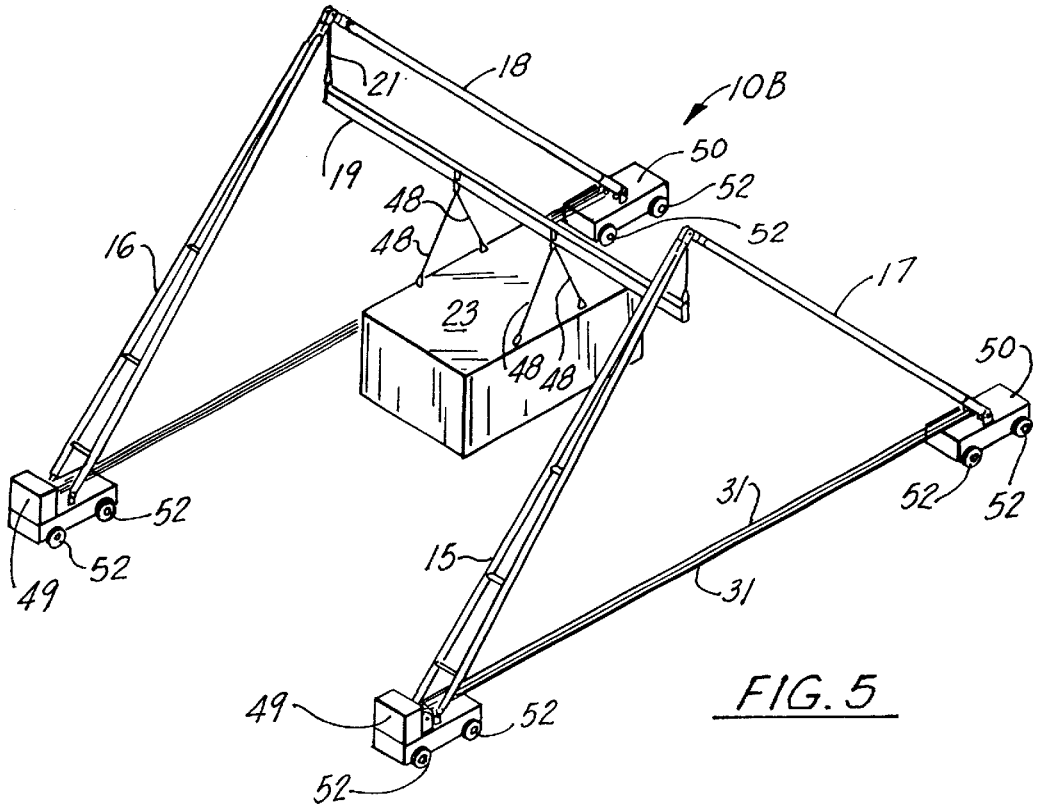
FIG. 5 is a perspective view of the second embodiment of the apparatus of the present invention.
Figure 7:
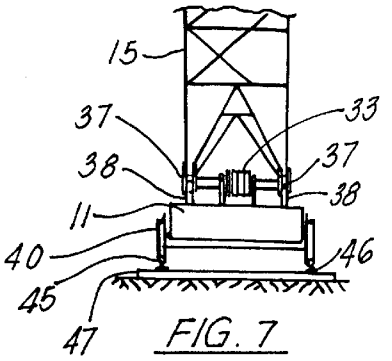
FIG. 7 is a partial elevation view of the preferred embodiment of the apparatus of the present invention.
Figure 8:
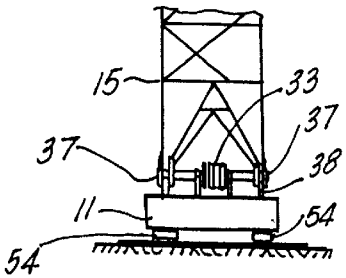
FIG. 8 is a partial elevational view of the second embodiment of the present invention.
Figure 9:
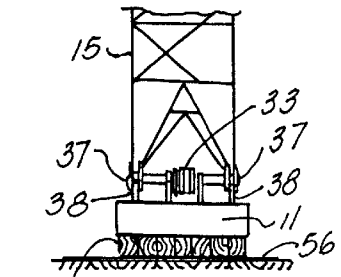
FIG. 9 is a partial elevational view of an alternate embodiment of the carriage showing a skid type carriage.
Figure 6:
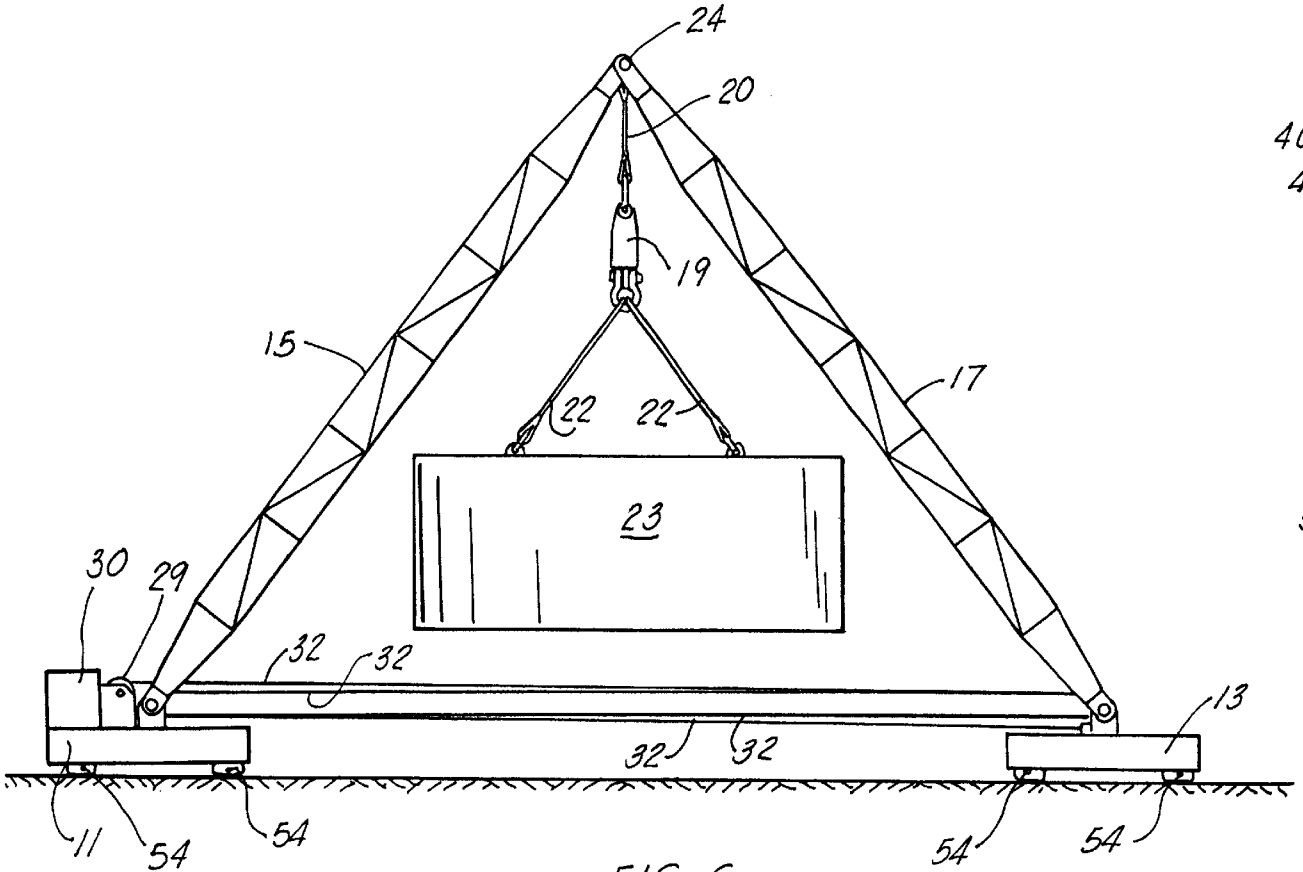
FIG. 6 is an elevational view of a third embodiment of the apparatus of the present invention.

An alternate embodiment of the apparatus of the present invention is shown in FIGS. 4 and 5, designated generally by the numeral 10B. In the embodiment of FIGS. 4 and 5, the wheels 40 are replaced with tires 52 that would engage a flat underlying surface 51 during use. It should be understood however that carriages such as 11, 12, 13, 14 and 49, 50 could also be in the form of skid-mounted or sled-mounted carriages that do not require wheels 40 or tires 52 for operation but rather roll upon small rollers such as Hillman® type rollers 54 as shown in FIGS. 6 and 8 or slide upon a flat underlying surface, as shown in FIG. 9. In FIG. 9, each chassis has an underlying wooden base 55 that slides upon a metal plate 56 (or a plurality of such plates).

FIGS. 10–16 show a third embodiment of the apparatus of the present invention designated generally by the numeral 10C in FIGS. 10, 11, 12, 13, and 14.

Figure 10:
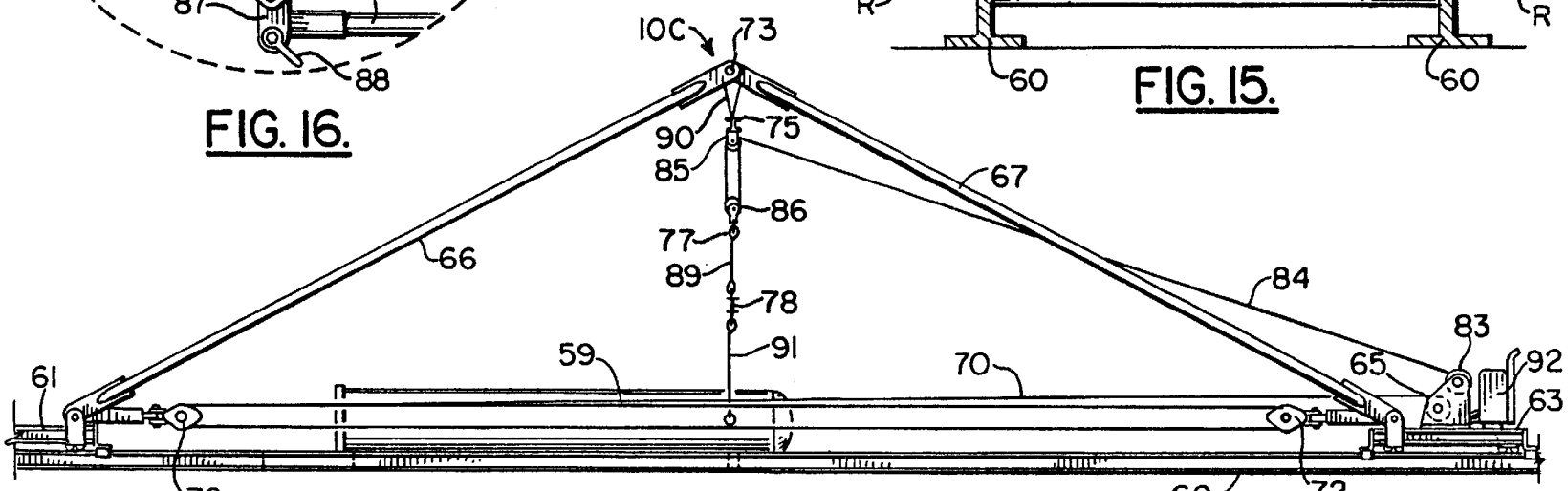
FIG. 10 is an elevational view of a third embodiment of the apparatus of the present invention shown prior to lifting of a horizontally positioned vessel.
Figure 11:
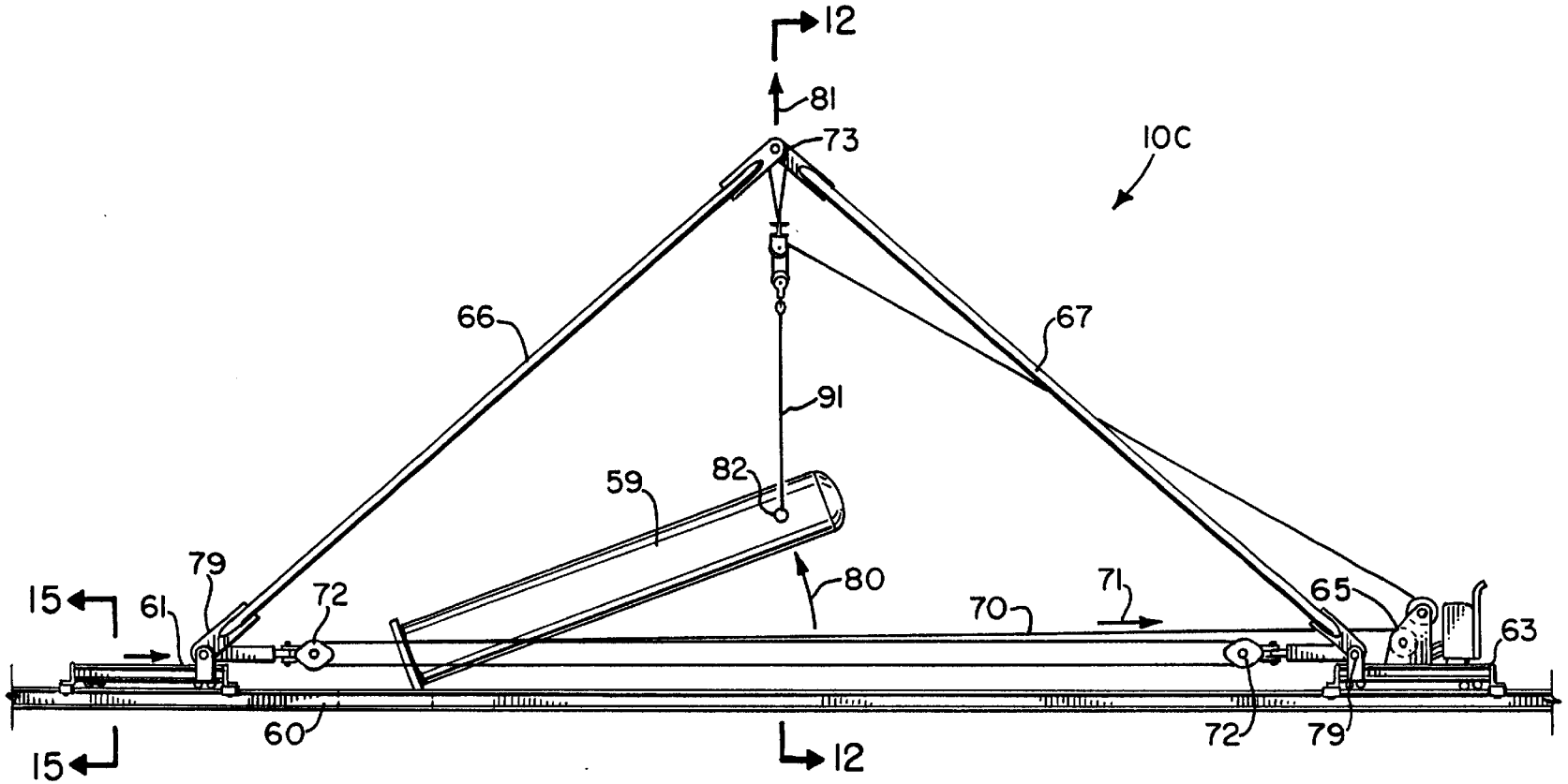
FIG. 11 is another elevational view of the third embodiment of the apparatus of the present invention.
Figure 12:
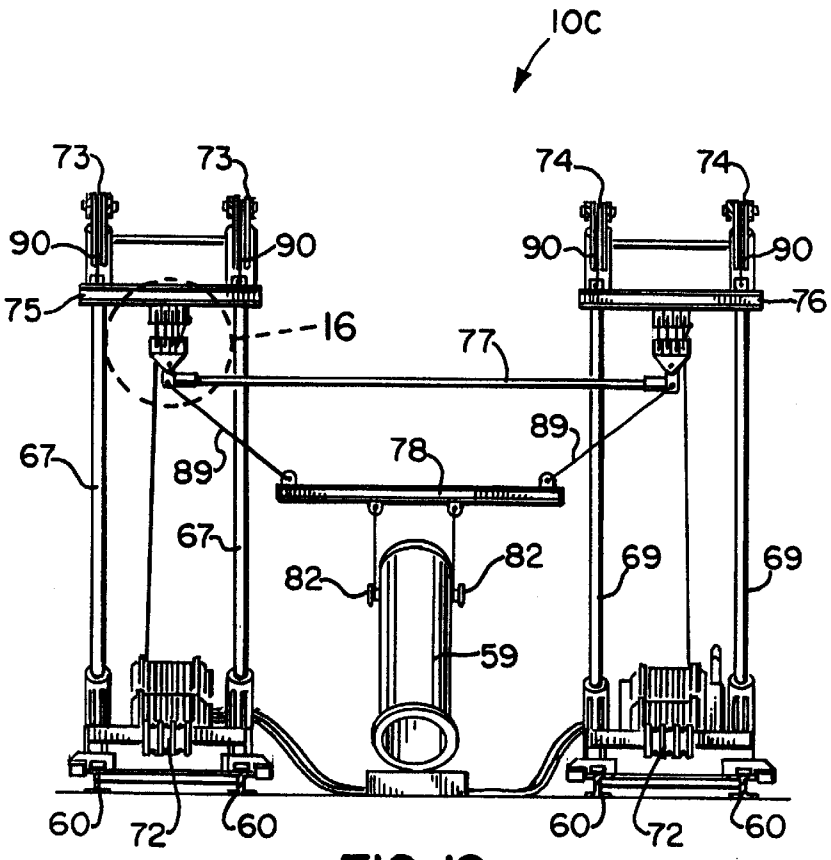
FIG. 12 is an end elevational view of the third embodiment of the apparatus of the present invention shown during lifting of the vessel, taken along lines 12—12 of FIG. 11.
Figure 14:
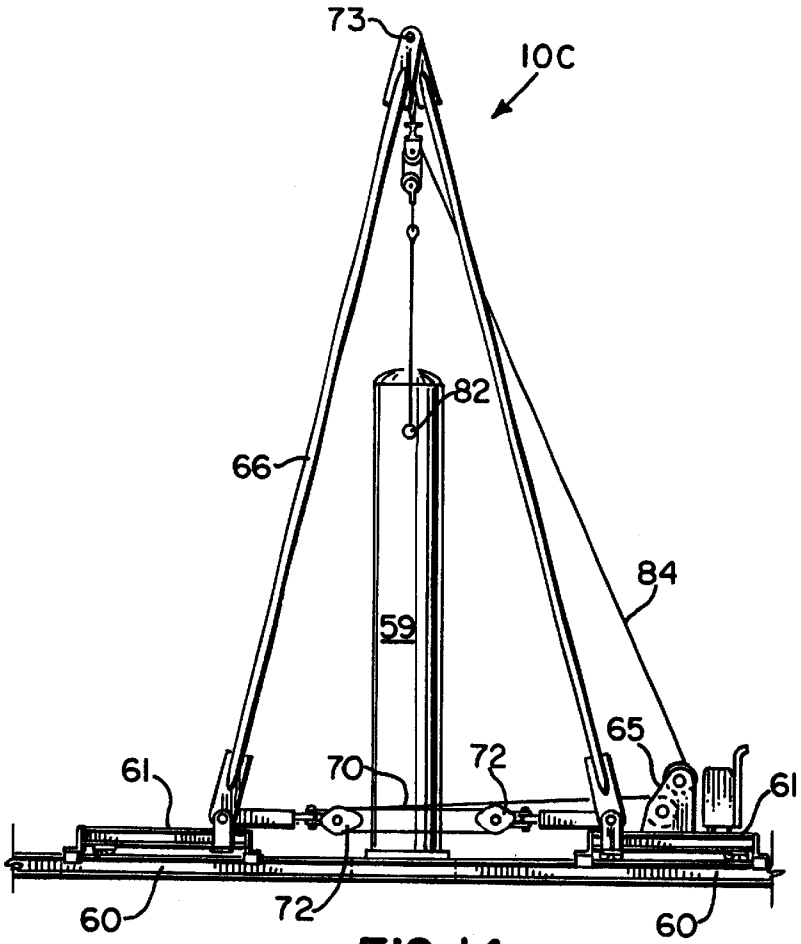
FIG. 14 is an end elevational view of the third embodiment of the apparatus of the present invention shown after the vessel has been lifted to a vertical position.
Figure 13:
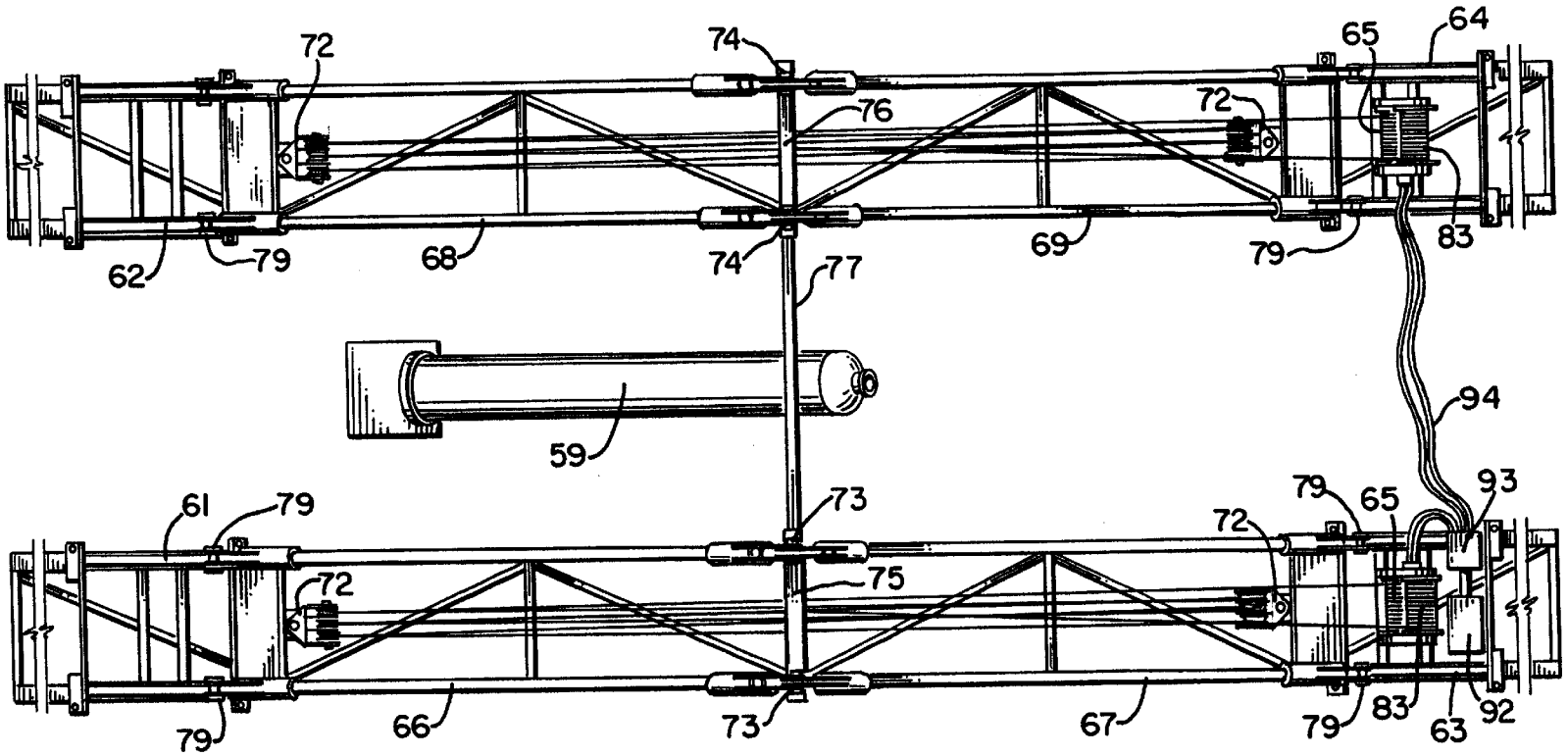
FIG. 13 is a top plan view of the third embodiment of the apparatus of the present invention.

Lifting apparatus 10C is shown lifting a vessel 59 from a generally horizontal position as shown in FIG. 10 to the vertical position shown in FIG. 14. FIGS. 11, 12, and 13 show the vessel 59 in an inclined position as occurs during the lift.

As with the first and second embodiments of FIGS. 1–9, lifting apparatus 10C includes a plurality of carriages that support booms in an opposed and parallel relationship. As with the embodiments of FIGS. 1–9, a pair of booms are pinned and supported respectively by a pair of carriages. A second pair of carriages and respective booms is positioned next to and generally parallel to the first pair of carriages and booms. This arrangement can be seen in FIGS. 10–14 in the drawings.

Figure 15:
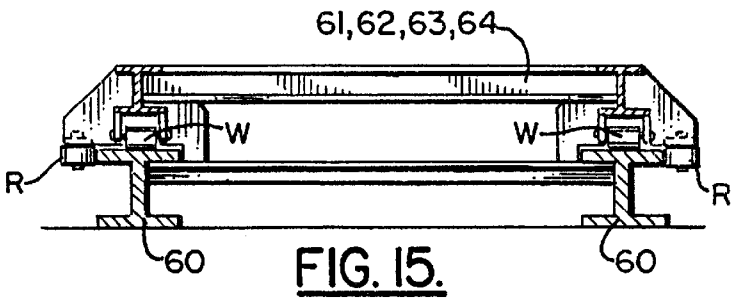
FIG. 15 is a transverse sectional view of the third embodiment of the apparatus of the present invention illustrating the track and carrier undercarriage portions thereof, taken along lines 15—15 of FIG. 11.

A first pair of carriages 61, 62 are mounted upon supports such as rails 60 (see FIG. 15). The carriage 61 supports a boom 66, connected at its base to the carriage 61 with pinned connection 79. Similarly, a second boom 67 is attached to the carriage 63 at pinned connection 79. The booms 66 and 67 have upper end portions that are pinned at connection 73 as shown in FIGS. 10 and 13.

A second pair of carriages 62, 64 are supported by a second set of supports (e.g., rails) 60. Each carriage 61, 62, 63, 64 can have supporting wheels W engage supports 60. Rollers R can be used to engage the sides of rail supports 60 for lateral stability. Each of the carriages 61, 62, 63, 64 has a winch 65 that is wound with cable 70 and upon sheaves 72. This rigging can best be seen in FIGS. 10 and 13. Each carriage 61, 62, 63, 64 provides a sheave 72. The pair of carriages 61 and 63 have a winch 65 that takes up the cable 70 during lifting in order to pull the carriages 61, 63 together. Similarly, the pair of carriages 62, 64 have a winch 65 that takes up the cable 70 during lifting in order to pull the carriages 62, 64 together. The cable 70 can be wrapped several times around the sheaves 72 as shown in FIG. 13 for increasing lifting capacity. In FIG. 11, arrow 71 indicates the direction of travel of cable 70 as it is taken up by winch 65 on each of the carriages 63, 64 during a lift. As the winch 65 on carriages 63 takes up cable 70, as shown in FIG. 11, the apex of the booms 66, 67 as defined by pinned connection 73 elevates in the direction of arrow 81 as shown in FIG. 11. At the same time, winch 25 on carriage 64 takes up cable to elevate the apex of booms 68, 69. The vessel 59 gradually inclines during lift as shown by arrow 80 as the vessel is lifted by a rigging supported by the pinned connections 73, 74, and attached to the upper end of the vessel at attachment 82.

In FIGS. 11–13, the vessel 59 is in the inclined position as occurs during a lift. In FIG. 14, the vessel 59 is in a vertical position after the lift is complete.

Figure 16:
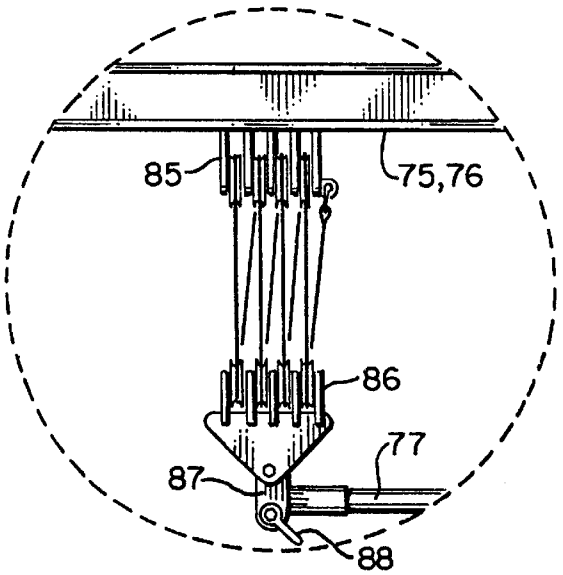
FIG. 16 is a fragmentary view of the preferred embodiment of the apparatus of the present invention illustrating the connection between the horizontal beam portions thereof.

A second winch 83 is provided on each of the carriages 63, 64 for providing a load line 84. The load line 84 can be rigged between crown block 85 and traveling block 86. The crown block 85 and traveling block 86 enable lifting and elevation change for the package in addition to the lifting elevation change achieved by changing inclination of the booms 66, 67, 68, 69. In FIG. 16, a detail of the rigging between beams 75, 76 and the horizontal beams 77 is shown. A crown block 85 can be attached by welding, for example, to each of the horizontal beams 75, 76. A traveling block 86 is attached to each end of horizontal beam 77, being pinned thereto at end caps 87. Such end caps 87 are commercially available, being manufactured by Versabar, Inc. of Belle Chasse, La. A shackle 88 depends from each end cap 87 and supports a diagonally extending sling 89. Each sling 89 (see FIG. 12) supports an end of lower horizontal beam 78.

The two upper horizontal beams 75, 76 are supported below the pinned connections 73, 74 respectively of booms 66, 67 and 68, 69. Slings 90 can be used to form an attachment between pinned connection 73 and the upper horizontal beams 75. Slings 90 can also form an attachment between pinned connection 74 and beam 76. A pair of slings 91 can be extended between lower horizontal beam 78 and vessel 59 as shown in FIGS. 10 and 12.

Winches 65, 83 can be powered with a power source such as diesel engine 92. Hydraulic pumps 93 with associated control valves can be powered by engine 92 for operating winches 65, 83. The winches 65, 83 can thus be hydraulic winches such as those manufactured by Fritz Culver, Inc. Hydraulic hose flow lines 94 can be used to interface each of the winches 65, 83 on the carriages 63, 64 with engine 92.

PARTS LIST

The following is a list of suitable parts and materials for the various elements of the preferred embodiment of the present invention.

| Part Number | Description |
|---|---|
| 10A | lifting apparatus |
| 10B | lifting apparatus |
| 10C | lifting apparatus |
| 11 | carriage |
| 12 | carriage |
| 13 | carriage |
| 14 | carriage |
| 15 | boom |
| 15A | upper end |
| 15B | upper end |
| 15C | longitudinal axis |
| 16 | boom |
| 17 | boom |
| 17A | upper end |
| 17B | upper end |
| 18 | boom |
| 19 | beam |
| 20 | sling |
| 21 | sling |
| 22 | sling |
| 23 | package |
| 24 | pinned connection |
| 24A | transverse pin |
| 25 | pinned connection |
| 26 | arrow |
| 27 | arrow |
| 28 | arrow |
| 29 | winch |
| 30 | motor drive |
| 31 | cable |
| 32 | arrow |
| 33 | sheave |
| 34 | sheave |
| 35 | chassis |
| 36 | upper surface |
| 37 | pinned connection |
| 38 | padeye |
| 39 | cable anchor |
| 40 | wheel |
| 41 | chassis |
| 42 | upper surface |
| 43 | padeye |
| 44 | pinned connection |
| 45 | rail |
| 46 | rail |
| 47 | crosstie |
| 48 | rigging |
| 49 | carriage |
| 50 | carriage |
| 51 | flat surface |
| 52 | tire |
| 53 | arrow |
| 54 | rollers |
| 55 | wooden base |
| 56 | metal plate |
| 59 | vessel |
| 60 | rail support |
| 61 | carriage |
| 62 | carriage |
| 63 | carriage |

-continued

PARTS LIST

The following is a list of suitable parts and materials for the various elements of the preferred embodiment of the present invention.

| Part Number | Description |
|---|---|
| 64 | carriage |
| 65 | winch |
| 66 | boom |
| 67 | boom |
| 68 | boom |
| 69 | boom |
| 70 | cable |
| 71 | arrow |
| 72 | sheave |
| 73 | pinned connectjon |
| 74 | pinned connection |
| 75 | beam |
| 76 | beam |
| 77 | beam |
| 78 | beam |
| 79 | pinned connection |
| 80 | arrow |
| 81 | arrow |
| 82 | attachment |
| 83 | winch |
| 84 | load line |
| 85 | crown block |
| 86 | traveling block |
| 87 | end cap |
| 88 | shackle |
| 89 | sling |
| 90 | sling |
| 91 | sling |
| 92 | engine |
| 93 | hydraulic pumps |
| 94 | flow lines |
| R | roller |
| W | wheel |

The foregoing embodiments are presented by way of example only; the scope of the present invention is to be limited only by the following claims.

What is claimed is:

1. A method for lifting a multi-ton package comprising the steps of:

a) supporting first and second booms respectively from first and second carriages, wherein the lower end portion of a first boom is pinned to said first carriage and the lower end portion of a second boom is pinned to said second carriage each boom having upper and lower end portions;

b) supporting third and fourth booms from third and fourth carriages, wherein the lower end portion of the third boom is pinned to the third carriage and the lower end portion of the fourth boom is pinned to the fourth carriage each boom having upper and lower end portions;

c) pinning the upper end portion of the first and second booms together to define a first boom apex;

d) pinning the upper end portion of the third and fourth booms together to define a second boom apex;

e) suspending a lifting beam from the upper end portions of the respective pairs of booms; and f) lifting the package with rigging that depends from the lifting beam by tightening a first cable that links the first and second carriages and by tightening a second cable that links the third and fourth carriages, thus increasing the angle of inclination of the booms and raising the apex of each of the paired booms.

2. The method of claim 1 wherein the first pair of booms occupy a first plane and the second pair of booms occupy a second plane and further comprising the step of positioning the booms during a lift so that the first and second planes are parallel.

3. The method of claim 1 wherein a plurality of the carriages have powered winches thereon and further comprising the step of powering the winches to tighten the cables during lifting in step "f".

4. The method of claim 1 wherein at least some of the carriages are wheeled.

5. The method of claim 1 further comprising the step of providing a winch on at least two of the carriages to form a load line as part of the rigging, and using the load line to shorten the rigging in between the package and the apex of each pair of booms.

6. The method of claim 1 wherein each boom is an elongated linear structural boom member, and further comprising the step of gradually increasing the inclination of each boom during lifting.

7. The method of claim 1 further comprising the step between steps "e" and "f" of providing sheaves on each carriage and winding cables respectively about the sheaves on the first and second carriages multiple times, and on the third and fourth carriages multiple times.

8. The method of claim 1 further comprising the step of mounting each of the carriages on rail supports.

9. The method of claim 1 further comprising the step of supporting the beam with slings that depend from the pinned connection at the upper end portion of the booms.

10. A lifting apparatus for lifting a multi-ton package, comprising:

a) a plurality of carriages that define a structural base for supporting a load, at least some of the carriages being movable;

b) a truss supported by the plurality of carriages, the truss defining a load transfer between the carriages and the multi-ton package to be lifted;

c) the truss including multiple booms extending respectively from the plurality of carriages;

d) wherein a first pair of carriages of said plurality of carriages supports a first pair of said multiple booms with boom upper end portions that are connected together at a first boom apex;

e) wherein a second pair of carriages of said plurality of carriages supports a second pair of said multiple booms with boom upper end portions that are connected together at a second boom apex;

f) a lifting beam that is supported below the first and second apexes;

g) a first variable length member that connects the first pair of booms and their supporting carriages for pulling the carriages and booms together so that the booms of the first pair increase in inclination during lifting; and h) a second variable length member that connects the second pair of booms and their supporting second pair of carriages for pulling the carriages and booms together so that the booms of the second pair increase in inclination during lifting.

11. The lifting apparatus of claim 10 wherein at least some of the carriages are wheeled.

12. The lifting apparatus of claim 10 wherein the carriages are wheeled and further comprising tracks for supporting the wheeled carriages wherein the wheels engage and travel upon the tracks during use.

13. The lifting apparatus of claim 10 wherein each truss is generally triangular in shape.

14. The lifting apparatus of claim 10 wherein each triangular-shaped truss includes two booms and a variable length tensile member defining three sides of the triangular shape.

15. The lifting apparatus of claim 10 wherein each variable length member includes a cable.

16. The lifting apparatus of claim 10 wherein the variable length member is a cable.

17. The lifting apparatus of claim 16 further comprising a winch for taking up the variable length cable member.

18. The lifting apparatus of claim 10 wherein each variable length member carries tension during lifting.

19. The lifting apparatus of claim 10 wherein each variable length member is attached at one end portion to a carriage.

20. The lifting apparatus of claim 10 wherein each variable length member is attached at one end portion to a boom.

21. The lifting apparatus of claim 10 further comprising a sheave on the assembly of booms and carriages for increasing the mechanical advantage of each variable length member.

22. The lifting apparatus of claim 10 further comprising a plurality of sheaves on the carriages for increasing the mechanical advantage of each of the variable length members.

23. A lifting apparatus for lifting multi-ton deck packages, comprising:

a) a pair of lifting trusses, each lifting truss including a pair of booms with lower boom end portions, and upper boom end portions that are pinned together, b) each of the lifting trusses including a variable length tensile member that can pull the lower end portions of the respective booms of a lifting truss together to elevate the respective pinned connection of the truss;

c) a lifting beam supported by the pair of lifting trusses, the lifting beam elevating when the respective pinned connections are elevated;

d) each of the trusses including a load transfer carriage at the lower end portion of each boom for providing a load transfer interface between the trusses and an underlying support surface, and that enables the lower end portions of the booms to travel toward and away from each other for each truss;

e) rigging that extends between the lifting beam and the package to be lifted; and f) a load line that can shorten the distance between the lifting beam and the pinned connections.

24. The lifting apparatus of claim 23 wherein the load transfer carriages are wheeled.

25. The lifting apparatus of claim 23 wherein the load transfer carriages comprise at least one carriage with a powered winch thereon, and the tensile member is a cable that is wound upon the powered winch.

26. The lifting apparatus of claim 23 wherein there are a plurality of lifting beams and the rigging includes a plurality of slings extending between lifting beams.

27. The lifting apparatus of claim 23 wherein there are a plurality of lifting beams and the rigging includes a crown block and a traveling block on adjacent beams wound with cable.

28. The lifting apparatus of claim 23 wherein two of the carriages have a pair of winches thereon, one winch for changing the length of a variable length tensile member, the other winch having a load line wound thereon for shortening a portion of the rigging prior to or during a lift.

29. The lifting apparatus of claim 23 wherein the plurality of carriages include four carriages, a carriage holding the lower end portion of a boom.

30. The lifting apparatus of claim 23 wherein the plurality of carriages include four carriages, one carriage holding the lower end portion of a boom at a pinned connection between the boom and the carriage.

31. The lifting apparatus of claim 23 wherein the beam is suspended from the first and second pinned connections.

32. The lifting apparatus of claim 23 wherein the beam is suspended from a pair of slings that are attached to the first and second pinned connections respectively.

33. The lifting apparatus of claim 32 wherein the slings are flexible slings.

34. The lifting apparatus of claim 23 wherein the first and second pinned connections each include a transverse pin that extends through the upper end portion of each boom of each truss.

35. The lifting apparatus of claim 23 wherein the tensile member is a flexible cable.

36. The lifting apparatus of claim 23 wherein each boom has at least one sheave and the tensile member is a flexible cable that is wound upon the sheaves, the cable having one end portion anchored to a carriage and another end portion that is wound upon the winch.

37. A lifting apparatus for lifting a multi-ton object, comprising:

a) a first lifting truss having an apex, the first truss including a pair of booms, each with upper boom end portion, said end portions being connected together at an apex, the first and second trusses being spaced apart to provide a load carrying area there between that enables the object to be lifted to be placed in the load carrying area;

b) a second lifting truss, having an apex, the second truss including a pair of booms, each with upper boom end portion said end portions being connected together at an apex;

c) each lifting truss including a variable length tensile member that can pull the booms together, elevating the apex;

d) a lifting beam extending generally across the load carrying area, supported at spaced apart positions respectively by the pair of lifting trusses and connectable to the multi-ton object to be lifted, the lifting beam elevating when each boom apex is elevated; and e) each of the trusses including a load transfer apparatus at the lower end portions of the trusses for providing a load transfer interface between the trusses and an underlying support surface that enables the variable length tensile member to pull the booms toward and away from each other for each truss.

38. The lifting apparatus of claim 37 further comprising rigging that extends below the lifting beam and in between the lifting beam and the object to be lifted.

39. The lifting apparatus of claim 38 wherein the rigging includes multiple, generally horizontally extended beams.

40. The lifting apparatus of claim 39 wherein the rigging includes upper and lower beams positioned at different elevations with respect to each other.

41. The lifting apparatus of claim 40 wherein there are a pair of respective upper beams depending from the first and second lifting trusses.

* * * * *